US011633046B2

(12) United States Patent
Altemimei

(10) Patent No.: US 11,633,046 B2
(45) Date of Patent: Apr. 25, 2023

(54) SECTIONAL SEATING SYSTEM

(71) Applicant: Raad Altemimei, Orland Park, IL (US)

(72) Inventor: Raad Altemimei, Orland Park, IL (US)

( * ) Notice: Subject to any disclaimer, the term of this patent is extended or adjusted under 35 U.S.C. 154(b) by 0 days.

(21) Appl. No.: 17/460,846

(22) Filed: Aug. 30, 2021

(65) Prior Publication Data

US 2023/0067292 A1 Mar. 2, 2023

(51) Int. Cl.
*A47C 13/00* (2006.01)
*A47C 17/04* (2006.01)
*A47C 15/00* (2006.01)

(52) U.S. Cl.
CPC ..... *A47C 13/005* (2013.01); *A47C 15/002* (2013.01); *A47C 17/04* (2013.01)

(58) Field of Classification Search
CPC ..... A47C 13/005; A47C 7/42; A47C 7/546; A47C 15/002; A47C 17/04; A47C 17/02; A47C 4/02; A47C 4/028
USPC ..... 297/248
See application file for complete search history.

(56) References Cited

U.S. PATENT DOCUMENTS

| | | | | |
|---|---|---|---|---|
| 3,973,800 | A | 8/1976 | Kogan | |
| 5,000,512 | A * | 3/1991 | Laird | A47C 4/028 297/440.22 |
| 6,241,317 | B1 * | 6/2001 | Wu | A47C 4/02 297/440.1 |
| 7,213,885 | B2 | 5/2007 | White, III et al. | |
| 7,252,339 | B2 * | 8/2007 | Owens | A47C 7/42 297/440.16 |
| 7,419,220 | B2 | 9/2008 | White, III et al. | |
| 7,480,947 | B2 * | 1/2009 | Patella | F16B 12/60 5/52 |
| 7,547,073 | B2 | 6/2009 | White, III et al. | |
| 7,963,612 | B2 | 6/2011 | Nelson | |
| 8,783,778 | B2 | 7/2014 | Nelson et al. | |
| 9,277,826 | B2 | 3/2016 | Nelson et al. | |
| 9,668,581 | B1 * | 6/2017 | Hill | A47C 17/04 |
| 10,070,725 | B2 | 9/2018 | Nelson et al. | |
| 10,123,623 | B2 | 11/2018 | Nelson et al. | |

(Continued)

FOREIGN PATENT DOCUMENTS

| | | | |
|---|---|---|---|
| BR | 102014014155 | * | 1/2016 |
| FR | 2699058 | * | 6/1994 |

OTHER PUBLICATIONS joybird.com, Image of Notch Modular Side found at <joybird.com/modulars/notch-modular-side/>, Applicant provided cited reference to counsel on Jul. 15, 2021, 1 page.

(Continued)

*Primary Examiner* — Mark R Wendell
(74) *Attorney, Agent, or Firm* — Greensfelder, Hemker & Gale, P.C.; Richard C. Himelhoch

(57) ABSTRACT

A modular seating system is provided having one or more seat units that are connectable to each other by connection plates. The seat units include first connector components for connection to back units and/or arm units. The back units and arm units include second connector components configured to cooperate with the first connector components. The arm units are provided with two sets of the second connector components for connecting to the seat unit in a first position or a second position different than the first position. The first and second connector components are in the form of a rail and C-shaped bracket that can slide over the rail.

20 Claims, 18 Drawing Sheets

(56) References Cited

U.S. PATENT DOCUMENTS

| | | | | |
|---|---|---|---|---|
| 10,154,733 | B2 | 12/2018 | Nelson et al. | |
| 10,806,261 | B2 | 10/2020 | Nelson et al. | |
| 11,406,192 | B1 * | 8/2022 | Wu | A47C 7/42 |
| 2006/0279124 | A1 | 12/2006 | White, III et al. | |
| 2007/0085406 | A1 | 4/2007 | White, III et al. | |
| 2007/0257539 | A1 | 11/2007 | White, III et al. | |
| 2009/0315382 | A1 | 12/2009 | Nelson | |
| 2011/0298340 | A1 | 12/2011 | Nelson et al. | |
| 2016/0174715 | A1 | 6/2016 | Nelson et al. | |
| 2016/0206100 | A1 | 7/2016 | Nelson et al. | |
| 2017/0367486 | A1 | 12/2017 | Nelson et al. | |
| 2018/0078041 | A1 | 3/2018 | Nelson et al. | |
| 2018/0098631 | A1 | 4/2018 | Nelson et al. | |
| 2019/0142165 | A1 | 5/2019 | Nelson et al. | |
| 2020/0262696 | A1 | 8/2020 | Nelson et al. | |
| 2021/0000258 | A1 | 1/2021 | Nelson et al. | |
| 2021/0068547 | A1 * | 3/2021 | Hodgson | A47C 7/42 |
| 2022/0000266 | A1 * | 1/2022 | Nelson | A47C 13/005 |
| 2022/0104622 | A1 * | 4/2022 | Chen | A47C 4/02 |

OTHER PUBLICATIONS joybird.com, Image of Notch Modular U-Sofa Sectional (7 piece) found at <joybird.com/u-sofa-sectionals/notch-modular-u-sofa-sectional/>, Applicant provided cited reference to counsel on Jul. 15, 2021, 1 page.

elephantinabox.com, Image of Dynamic Sofa found at <elephantinabox.com/products/sofa-1>, Applicant provided cited reference to counsel on Jul. 15, 2021, 1 page.

elephantinabox.com, Image of dimensions of Dynamic Sofa found at <elephantinabox.com/products/sofa-1>, Applicant provided cited reference to counsel on Jul. 15, 2021, 1 page.

allform.com, Image of Armchair Modular Design found at <allform.com/products/armchair/sand-natural>, Applicant provided cited reference to counsel on Jul. 15, 2021, 1 page.

* cited by examiner

SECTIONAL SEATING SYSTEM

CROSS-REFERENCE TO RELATED APPLICATIONS

None.

FEDERALLY SPONSORED RESEARCH OR DEVELOPMENT

N/A

FIELD OF THE INVENTION

The present invention is directed to a modular seating system having a number of components that can be easily connected to each other to form a chair or couch in a variety of configurations.

DESCRIPTION OF THE PRIOR ART

A number of seating systems exist that can be arranged in different configurations. Many of these systems include various components for connecting elements of the system together. However, such systems can be complex and difficult to set up.

The present invention provides a modular seating system that can be shipped in individual components that can be easily connected to each other and assembled in a variety of configurations.

SUMMARY OF THE INVENTION

The present invention is directed to a modular seating system. The system includes a number of components that can be shipped individually and easily connected to create a variety of seating arrangements.

In accordance with one aspect of the invention, a modular seating system is provided. The system comprises a first seat having an upper surface, a first side wall extending downward from the upper surface, a second side wall extending down from the upper surface, a front wall extending downward from the upper surface and a back side wall extending downward from the upper surface. The first side wall has a set of first connector components and the back wall also has a set of first connector components. The system also comprises a first arm having a first set of second connector components for connecting the first arm to the first side wall of the first seat in a first position and a second set of second connector components for connecting the first arm to the first side wall of the first seat in a second position different than the first position. Additionally, the system comprises a first back having a first set of second connector components. The back is connected to the back wall of the first seat.

The first connector components of the system can be rails secured to the first seat. Each of the second connector components can be a slider having a generally squared off C-shaped cross-sectional shape configured to slideably fit over a respective rail. Additionally, the first connector components or the second connector components can include bearings.

The first seat can include a lower surface and a plurality of legs extending downward from the lower surface of the first seat. Similarly, both the back and the arm can include lower surfaces and legs extending downward from these surfaces.

The seat can also include a set of first connector components on a second side wall opposing the first side wall. The system can include a second arm having a first set of second connector components for connecting the arm to the seat in a first position and a second set of second connector components for connecting the arm to the seat in a second position different than the first position.

The system can include a second seat having an upper surface. The system can also include a first connector plate connecting the upper surface of the first seat to an upper surface of the second seat. The first connector plate can include a first opening and a second opening. A first screw is provided for securing the first plate to the first seat through the first opening and a second screw is provided for securing the first connector plate to the second seat through the second opening. The second seat can include a first side wall having a first set of first connector components and a back wall having a first set of first connector components. Both the first and second seats can be square, and can include a seat cushion.

Additionally, the system can include a second arm having a first set of second connector components for connecting the arm to the second seat in a first position and a second set of second connector components for connecting the second arm to the second seat in a second position different than the first position. The system can also include a second back having a first set of second connector components connected to the back wall of the second seat.

In accordance with another aspect of the invention, a modular seating system is provided comprising a first seat having an upper surface, a first side wall extending downward from the upper surface, a second side wall extending down from the upper surface, a front wall extending downward from the upper surface and a back side wall extending downward from the upper surface. The first side wall has a first set of first connector components and a second set of first connector components, and the back wall has a first set of first connector components. The system further comprises a first arm having a first set of second connector components and a first back having a first set of second connector components, the back connected to the back wall of the first seat.

Each of the first connector components can be a rail secured to the first seat. Each of the second connector components can be a slider having a generally squared off C-shaped cross-sectional shape configured to slideably fit over a respective rail.

The system can also comprise a second seat having an upper surface. A first connector plate can be used to connect the upper surface of the first seat to the upper surface of the second seat.

In accordance with another aspect of the invention a modular seating system is provided comprising a first seat having an upper surface and a lower surface, a first side wall extending downward from the upper surface, a second side wall extending down from the upper surface, a front wall extending downward from the upper surface and a back side wall extending downward from the upper surface. The first side wall has a first set of first connector components and the back wall has a first set of first connector components. The system also includes a first arm having a first set of second connector components for connecting the first arm to the first side wall of the first seat in a first position and a first back having a first set of second connector components, the back connected to the back wall of the first seat. The system also includes a second seat having an upper surface and a connector plate connecting the upper surface of the first seat to the upper surface of the second seat.

The first arm can include a second set of second connector components for connecting the first arm to the first side wall of the first seat in a second position different than the first position.

The first connector components can be a rail secured to the first seat and each of the second connector components can be a slider having a generally squared off C-shaped cross-sectional shape configured to slideably fit over a respective rail.

Other features and advantages of the invention will be apparent from the following specification taken in conjunction with the following Figures.

BRIEF DESCRIPTION OF THE DRAWINGS

To understand the present invention, it will now be described by way of example, with reference to the accompanying drawings in which.

DETAILED DESCRIPTION

Figure 2:
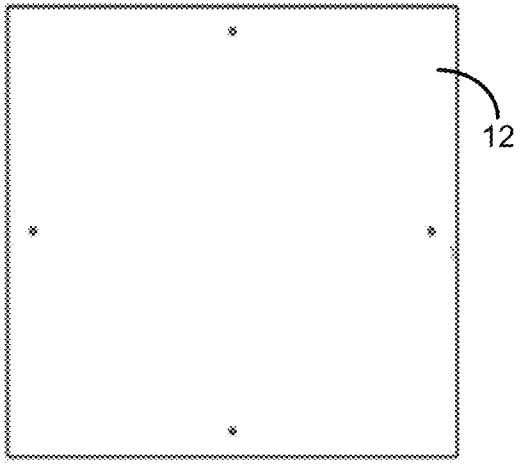
FIG. 2 is a top plan view of the seat of FIG. 1.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention is directed to a modular seating system that can be easily set up in a variety of configurations. The system can be set up as a chair, a loveseat, or a sectional couch that can be, for example, L-shaped, U-shaped or simply be an enlarged loveseat. A variety of other configurations can also be implemented. The basic components of the system can be shipped individually and then put together on site by the purchaser in the desired configuration. Additionally, the basic components include connectable structures that make assembly easy for anyone.

Figure 1:
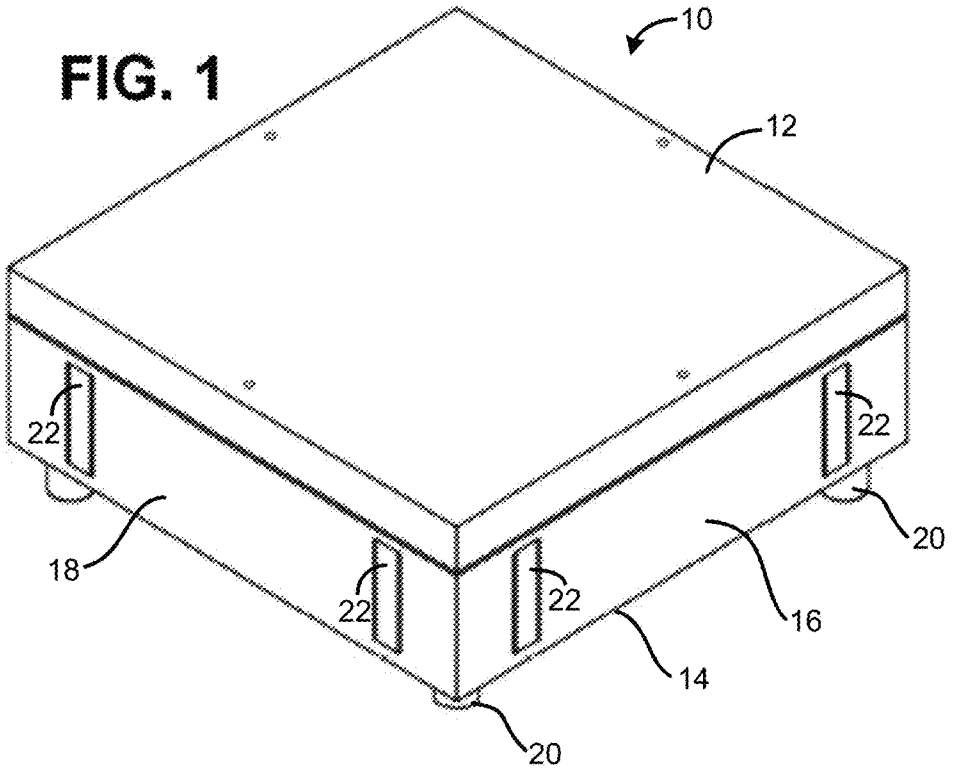
FIG. 1 is a perspective view of a seat in accordance with an embodiment of the present invention.
Figure 3:
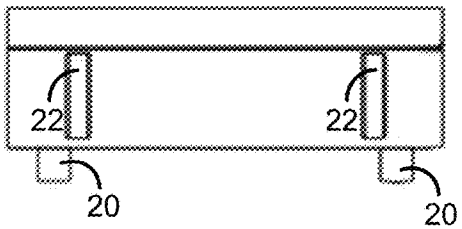
FIG. 3 is a first side plan view of the seat of FIG. 1.
Figure 5:
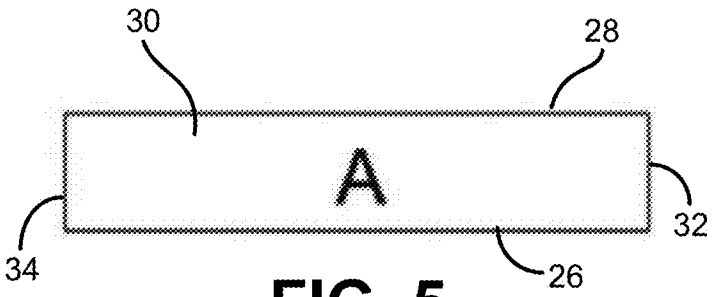
FIG. 5 is a top plan view of the back unit of FIG. 4.
Figure 4:
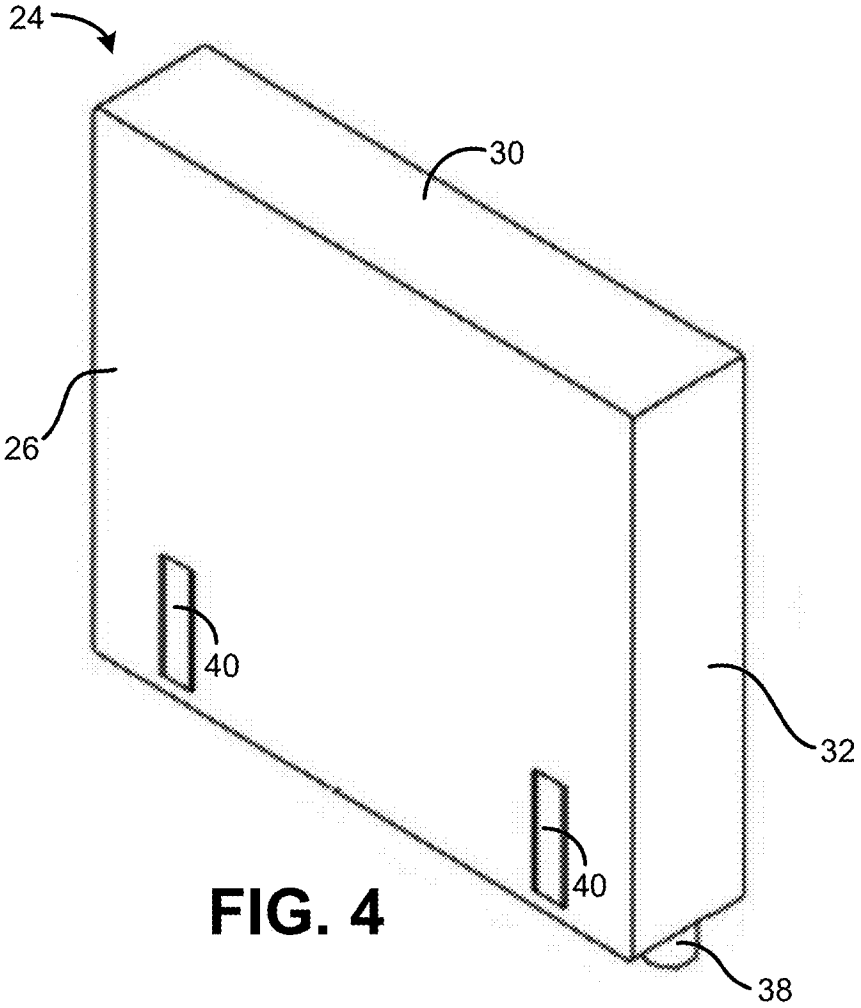
FIG. 4 is a perspective view of a back unit in accordance with an embodiment of the present invention.
Figure 7:
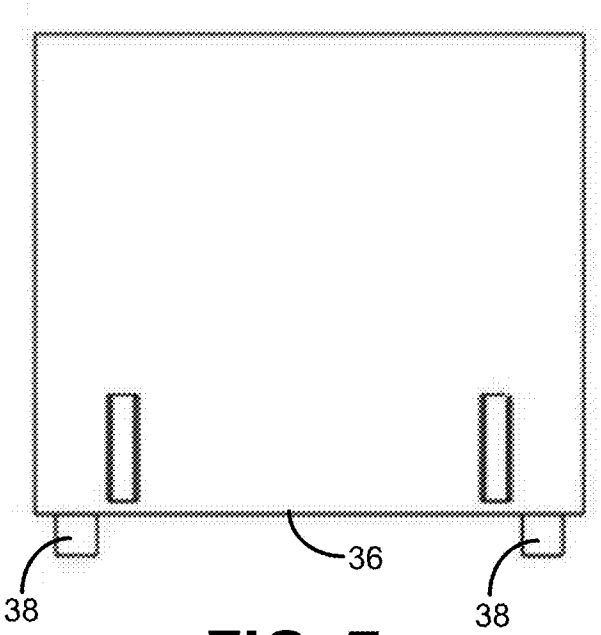
FIG. 7 is an interior side plan view of the back unit of FIG. 4.
Figure 6:
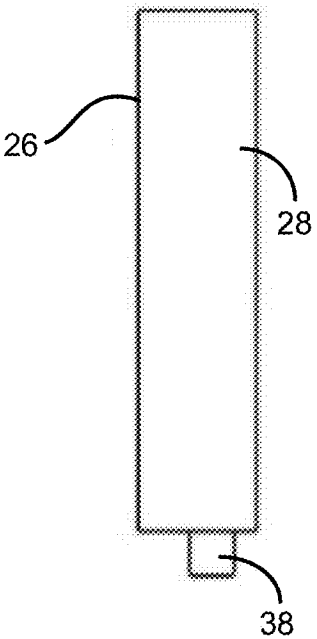
FIG. 6 is a side plan view of the back unit of FIG. 4.
Figure 8:
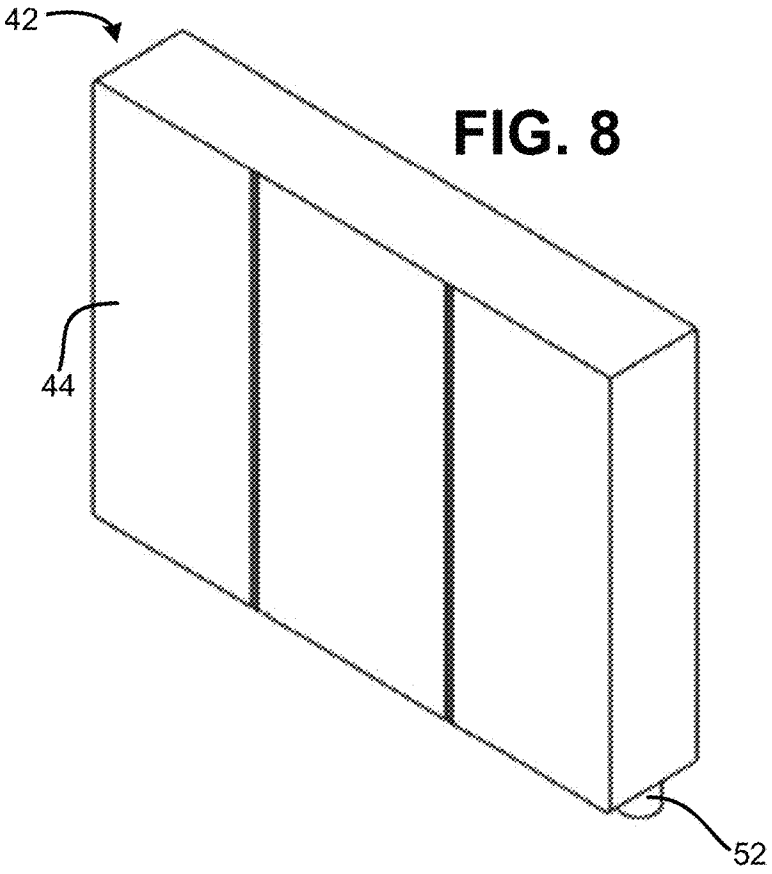
FIG. 8 is a perspective view of an arm unit in accordance with an embodiment of the present invention.
Figure 9:
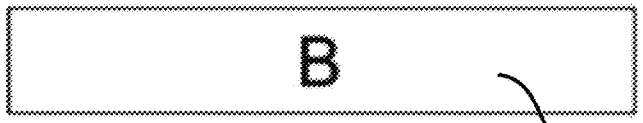
FIG. 9 is a top plan view of the arm unit of FIG. 8.
Figure 10:
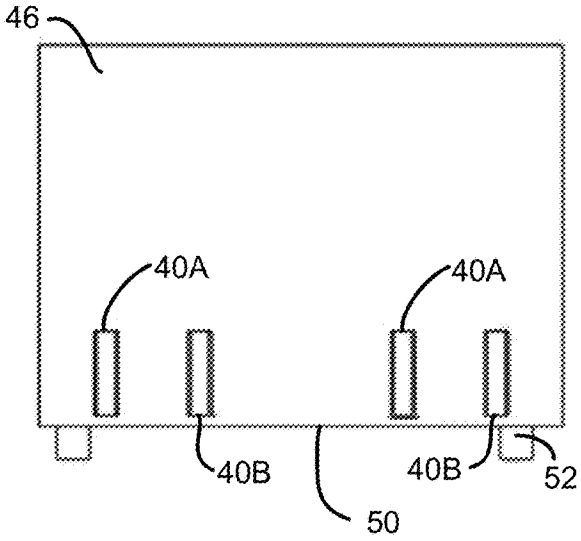
FIG. 10 is an interior side plan view of the arm unit of FIG. 8.
Figure 12:
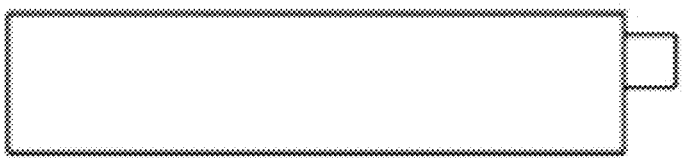
FIG. 12 is a front view of the arm unit of FIG. 8.
Figure 11:
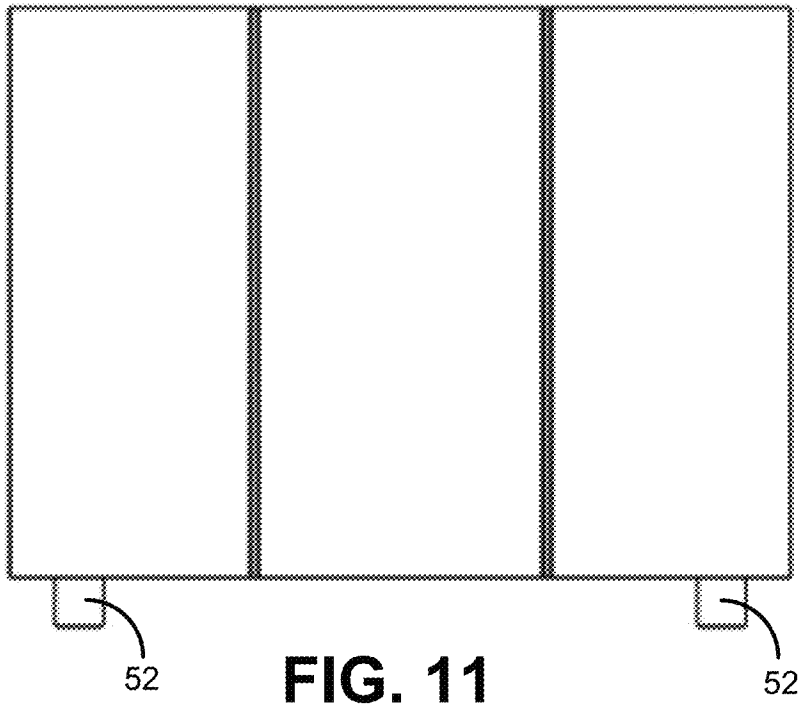
FIG. 11 is an exterior side plan view of the arm unit of FIG. 8.
Figure 15:
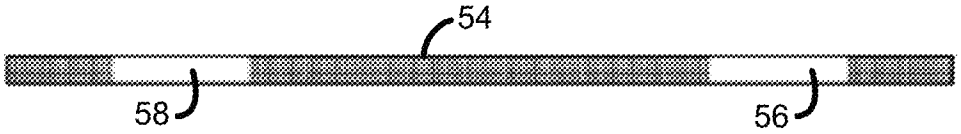
FIG. 15 is a cross-sectional side view of the connection plate of FIG. 13.
Figure 13:
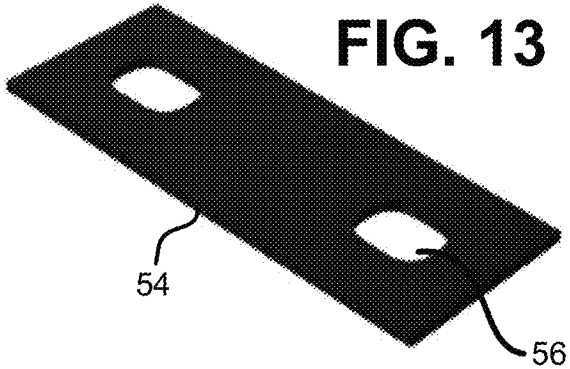
FIG. 13 is a perspective view of a connection plate in accordance with the present invention.
Figure 14:
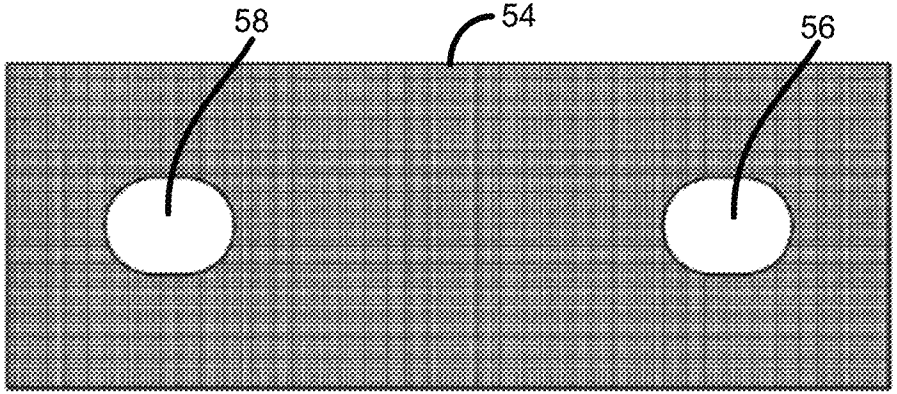
FIG. 14 is a top plan view of the connection plate of FIG. 13.

A seat unit 10 (or simply "seat") for use in the system is shown in FIGS. 1-3. The seat 10 includes a generally square upper surface 12 and four side walls extending downward from the four sides of the upper surface 12 to a bottom surface 14. A first side wall 16 and a second side wall 18 are shown in FIG. 1. A plurality of legs 20 extend downward from the bottom surface 14. The legs 20 are generally positioned proximate the corners of the bottom surface 14. The legs 20 are generally cylindrical, however, they can be in a variety of different shapes.

The seat unit 10 is shown in FIGS. 1-3 without a seat cushion. A seat cushion can be seen in FIGS. 20 and 22-23.

The seat 10 includes a set of first connector components 22 on the first side wall 16 and another set of connector components 22 on the second side wall 16. The seat 10 can also include a set of first connector components 22 on a third side wall (opposing the first side wall 16). Each of the connector components 22 in a set are spaced from each other. As discussed in more detail herein, the first connector components 22 are brackets that cooperate with second connector components on an arm unit or back unit.

FIGS. 4-7 show a back unit (or simply "back") 24 that can be used with the seat unit 10. The back 10 is generally rectangular having an interior side 26 (i.e., a side that would form a back surface of any chair or couch in a seating system, albeit supporting a back cushion), an exterior side 28, a top wall 30, a first side wall 32 and a second side wall 34. The back 24 also includes a bottom wall 36 and legs 38 extending downward from the bottom wall 36.

The interior side of the back also includes a set of second connector components 40. Each of the set of second connector components 40 are spaced out from each other to match the set of first connector components on the second side wall 18 of the seat 10.

The first connector components 22 and the second connector components 40 are designed to fit together to securely connect the back 24 to the seat 10. In this regard, one of the connector components is in the form of a rail having a generally rectangular cross-sectional shape, and the other component is a slider or bracket having a squared-off, generally C-shaped cross-sectional shape sized to slidingly fit over the rectangular cross-section of the rail. The first and second connector components 22, 40 are shown (without a seat or back unit) in FIGS. 26A-26C. Each connector component 22, 40 includes openings 74 to enable the connector to be secured to the seat or back (or arm as described below) with screws, nails or bolts, etc.

Figure 26C:
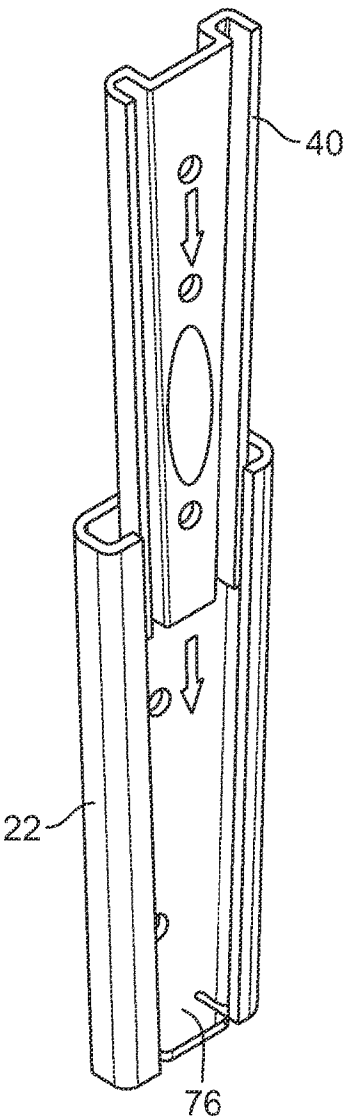
Figure 26B:
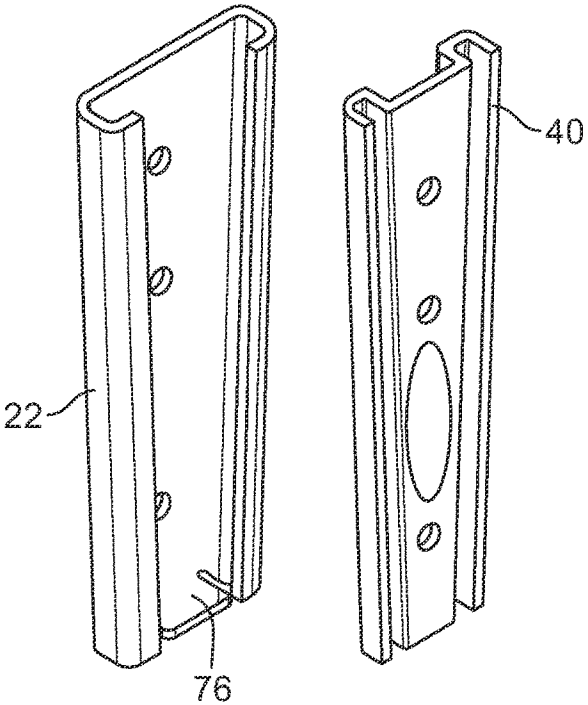
Figure 26A:
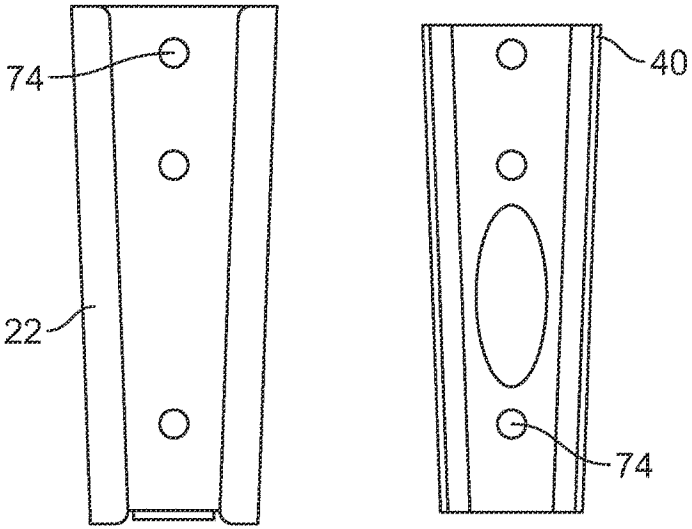

As shown in FIG. 26C, the second connector component 40 is sized and designed to fit in an opening (having the generally C-shaped cross-sectional shape) at the top of the first connector component 22 and slide downward. The first connector component 22 includes a bottom wall 76 to stop the second connector component 40. As illustrated in the front plan view of FIG. 26A, the top of the first connector component 22 is slightly wider than the bottom of the component, which causes the sides of the component to angle slightly toward each other (from top to bottom). Similarly, the second connector component 40 also has a slightly wider top (albeit smaller than that of the first connector component) than the bottom of the second connector component 40. Again, this causes the sides of the second connector component to angle slightly toward each other (from top to bottom). The angled sides of the components 22, 40 provide for a snug, secure fit when connected to each other while enabling the second component 40 to be easily removed when disassembling the system 10.

In some instances, one of the first or second connector components can be fitted with bearings to further facilitate the slide-ability of the bracket with respect to the rail. In this regard, the first and second connector components of the present system can be similar to the components of a drawer slide bracket or similar structures. In the present system, the first connector components 22 on the seat 10 are preferably the rail structures and the second connector components 40 on the back 24 are the C-shaped brackets that fit over the rails. However, these can be reversed if desired.

FIGS. 8-12 show an arm unit (or just "arm") 42 for use in the system. The arm 42 includes an exterior side 44, an interior side 46 and a top wall 48. The arm 42 also includes a bottom wall 50 and legs 52 extending downward from the bottom wall 50.

Similar to the back unit 24, the arm 42 also includes second connector components for connecting to the first connector components 22 on the seat 10. However, the arm 42 has two sets of staggered second connector components 40A and 40B. The first set of second connector components 40A allows for connecting the arm 42 to the seat 10 in a first position, and the second set of second connector components 40B allows for connecting the arm 42 to the seat 10 in a second position different than the first position. Additional sets of second connectors can be added as desired for additional positions (or to accommodate different sized or shaped seats). The back unit 24 can be similarly modified to include additional second connector components, and/or the seat 10 can be similarly modified to include additional first connector components.

With the first and second connector components, a seat 10 can be connected to a back unit 24 and one or more arm units 42 to form a chair. However, to form a more complex seating system, two or more seat units 10 can be connected together. The multiple seats 10, along with additional back units 24 and arm units 42 can form a sectional sofa or couch having a variety of configurations.

Figure 17:
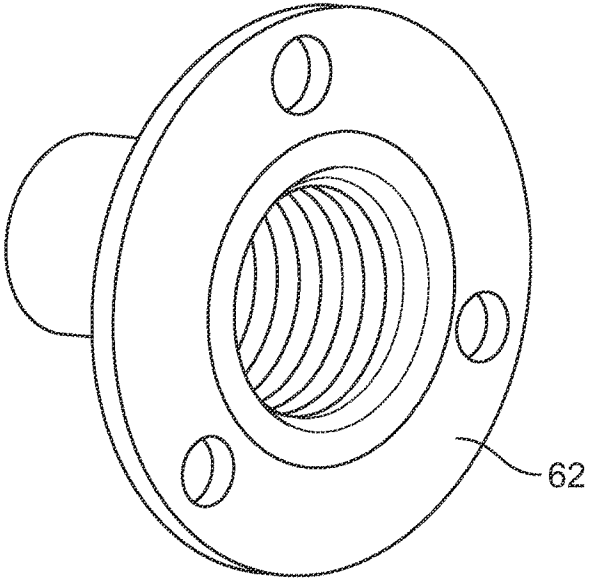
FIG. 17 is a perspective view of a nut for use with the connection plate of FIG. 13.
Figure 16:
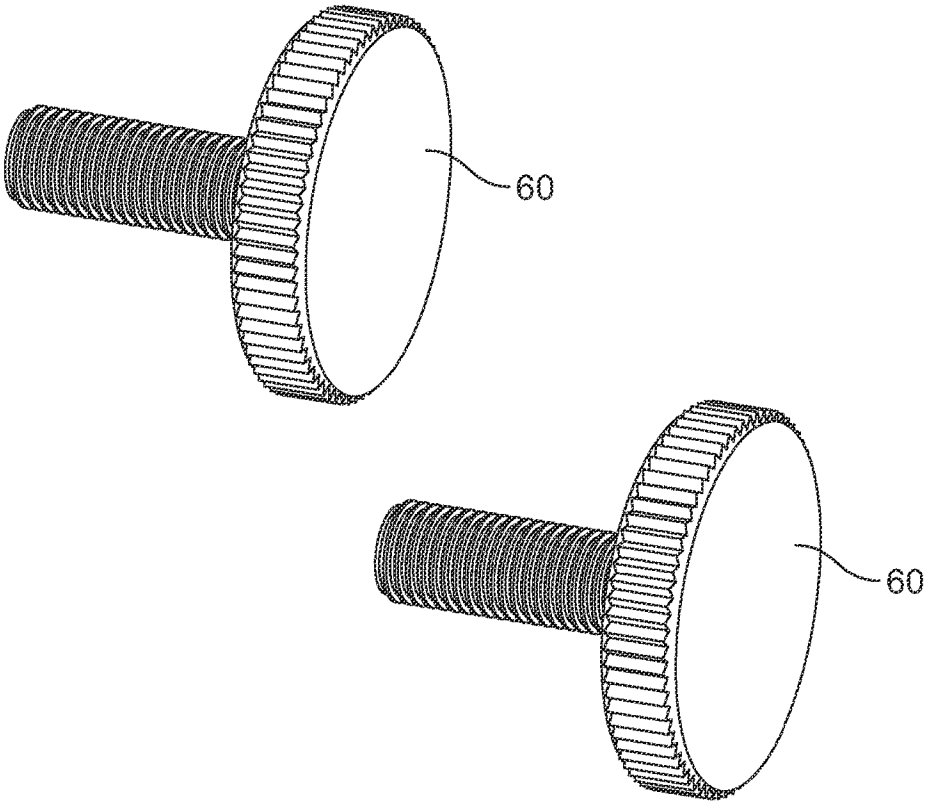
FIG. 16 is a perspective view of screws for use with the connection plate of FIG. 13.
Figure 18A:
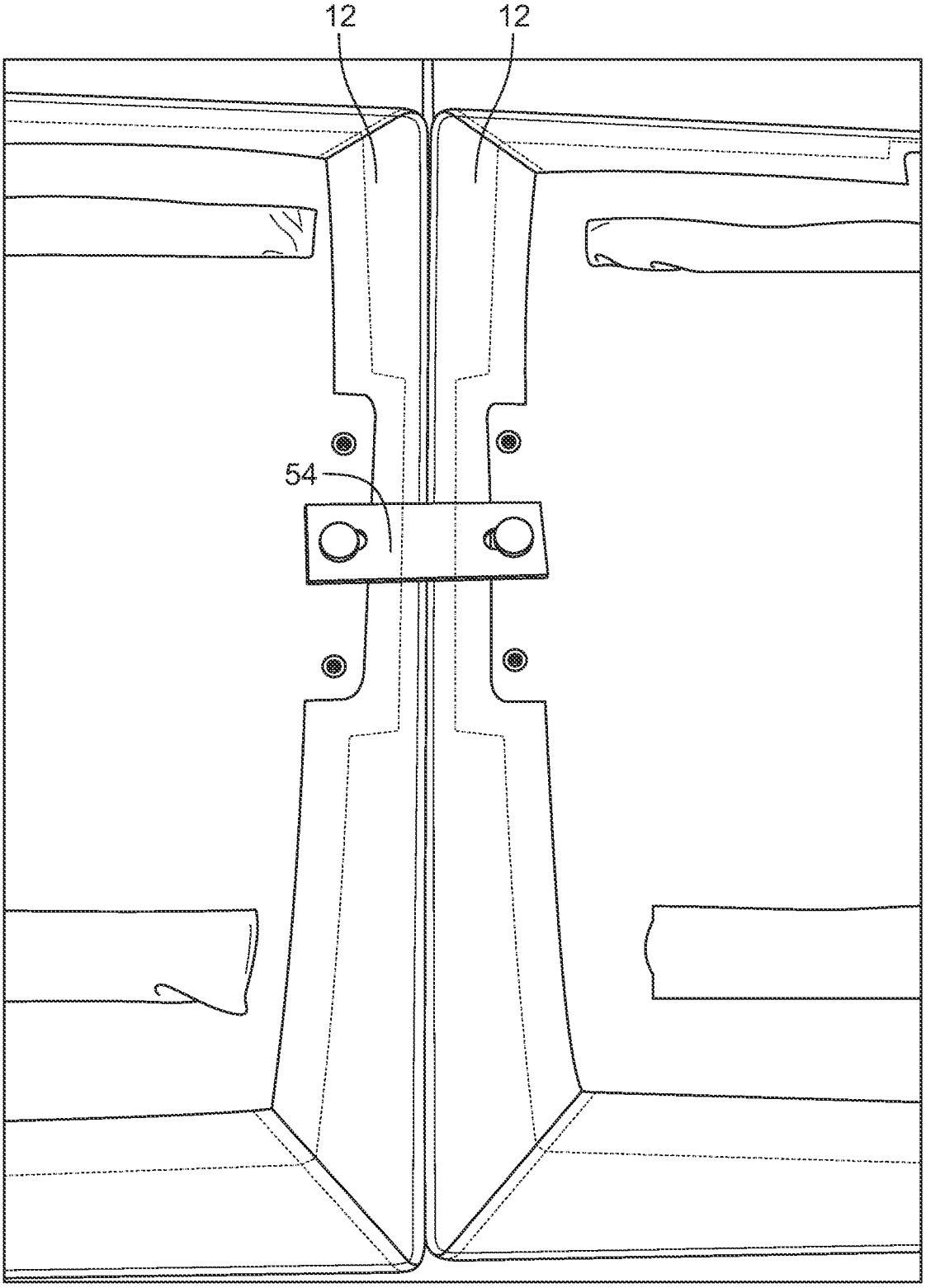
FIGS. 18A-18C are views of a connection plate connecting a first seat unit to a second seat unit.
Figure 18B:
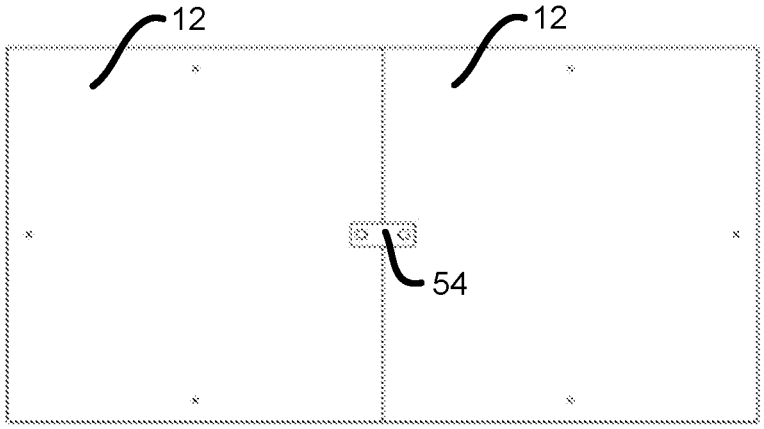
Figure 18C:
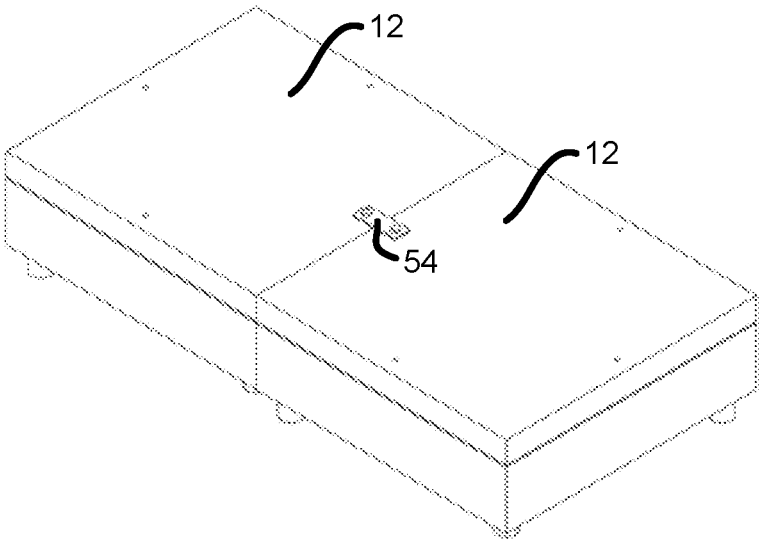

The present system includes a connection plate 54, as illustrated in FIGS. 13-19, for connecting a first seat 10 to a second seat 10. The connection plate 54 is generally rectangular and includes a first aperture 56 proximate a first end and a second aperture 58 proximate a second end. Screws 60 can be used to secure the connection plate 54 to the top surface 12 of the first seat 10 and the top surface 12 the second seat 10 as shown in FIG. 18 (alternatively, the connection plate could be secured to the bottom surfaces 14 of each seat). In some instances, the seat 10 can include a nut 62 (as shown in FIG. 17) or similar structure for receiving the screw 60. Additionally, other similar structure can be used to secure the connector plate 54 to the seats 10.

Figure 19A:
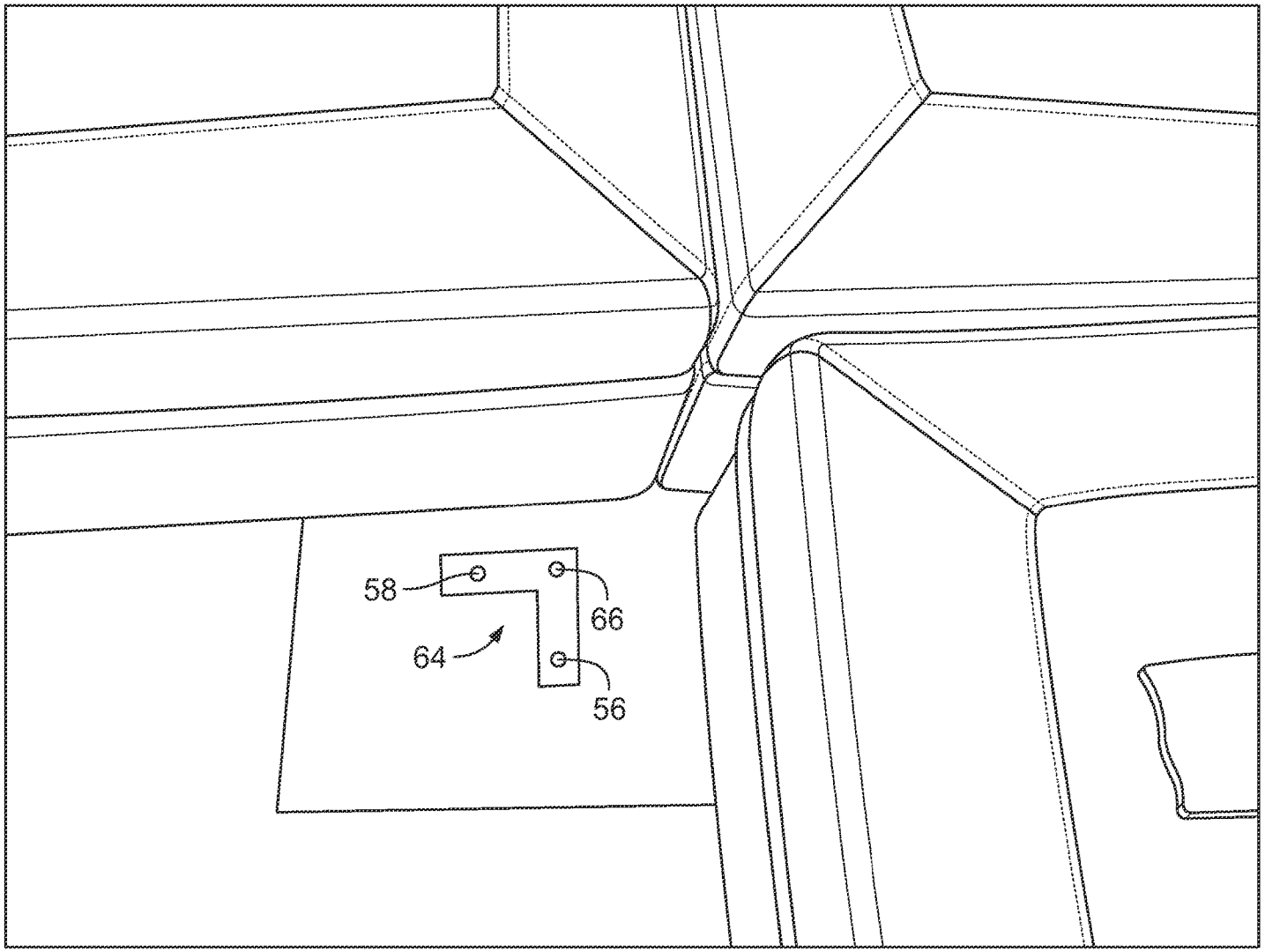
FIGS. 19A-19D are views of an L-shaped connection plate for use in securing three seat units together.
Figure 19C:
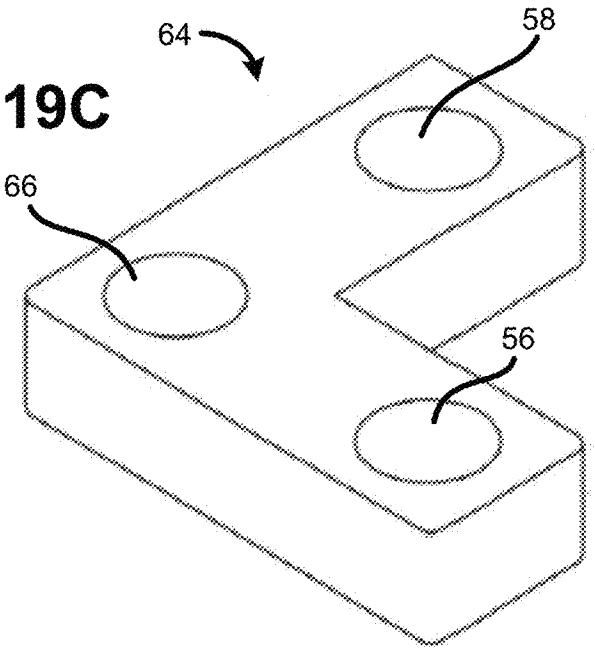
Figure 19B:
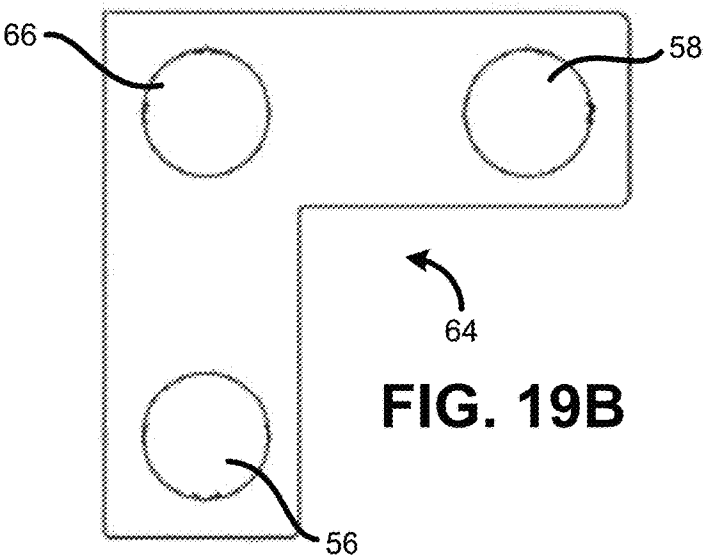
Figure 19D:
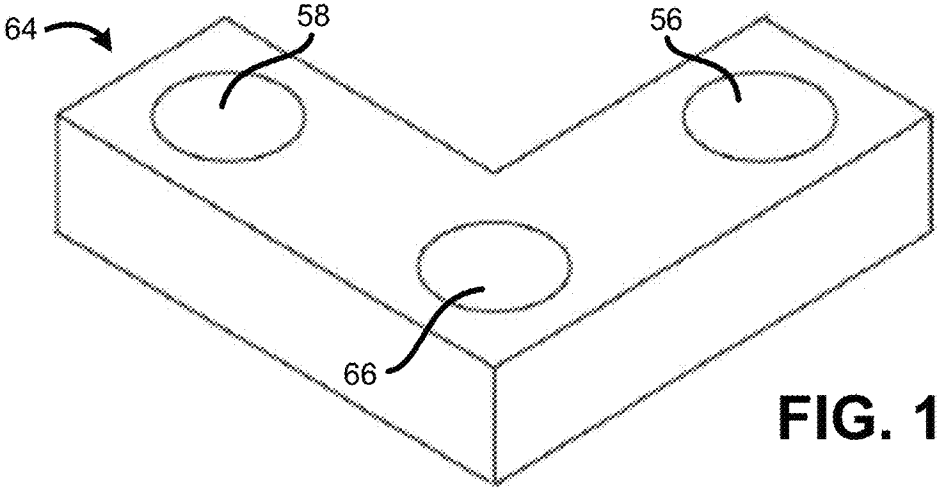

As shown in FIGS. 19A-D, an L-shaped connection plate 64 can be used to connect three seats 10 together in similar configuration (e.g., FIG. 19A). The L-shaped connection plate 64 includes a third aperture 66 proximate the bend in the plate between the first and second apertures 58 and 56. Each aperture in the L-shaped connection plate 64 is used to secure the connection plate 64 to one of three seat components 10.

Figure 20A:
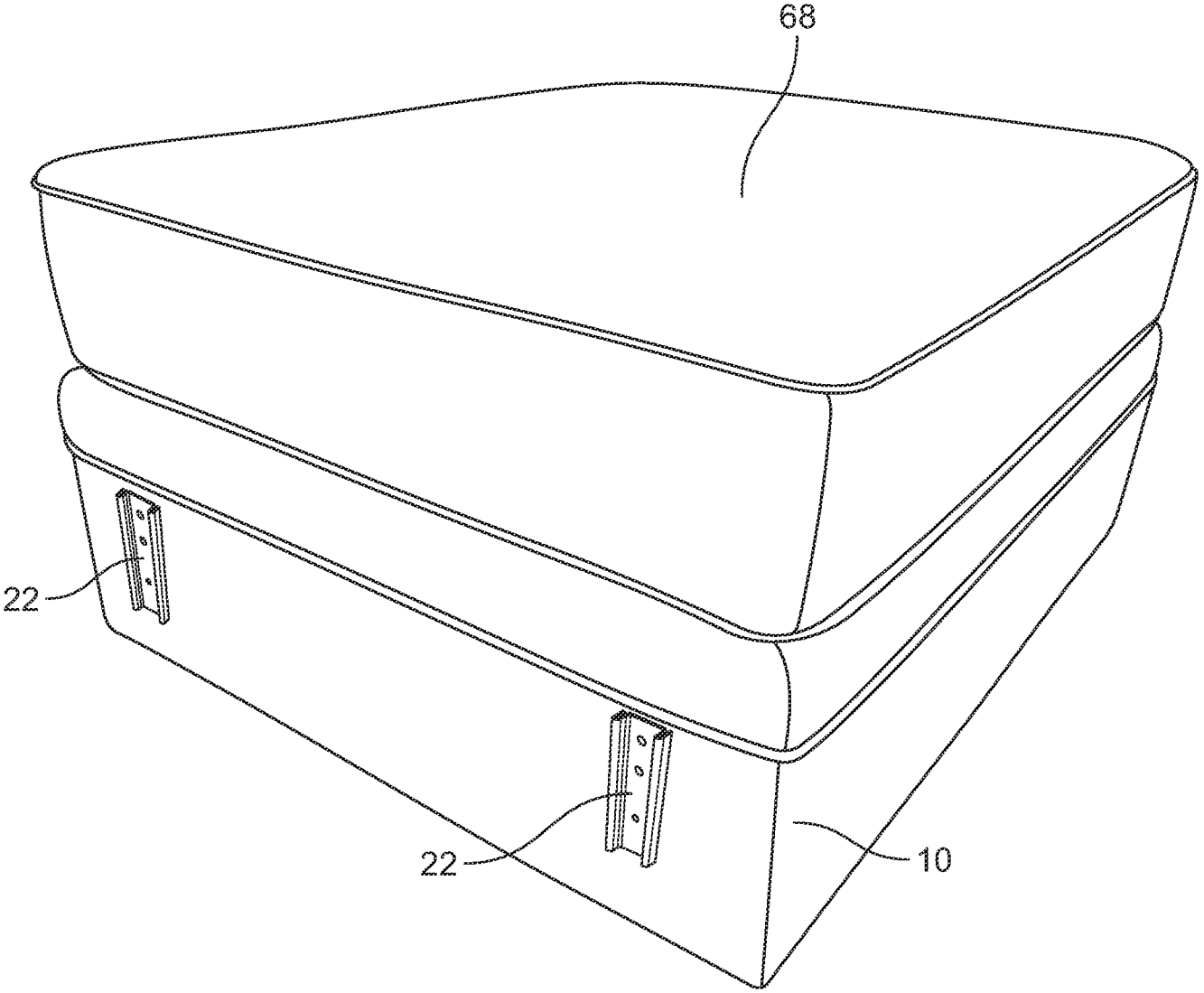
FIGS. 20A and 20B are perspective views of a seat unit with a seat cushion with and without cutouts for the fabric.
Figure 20B:
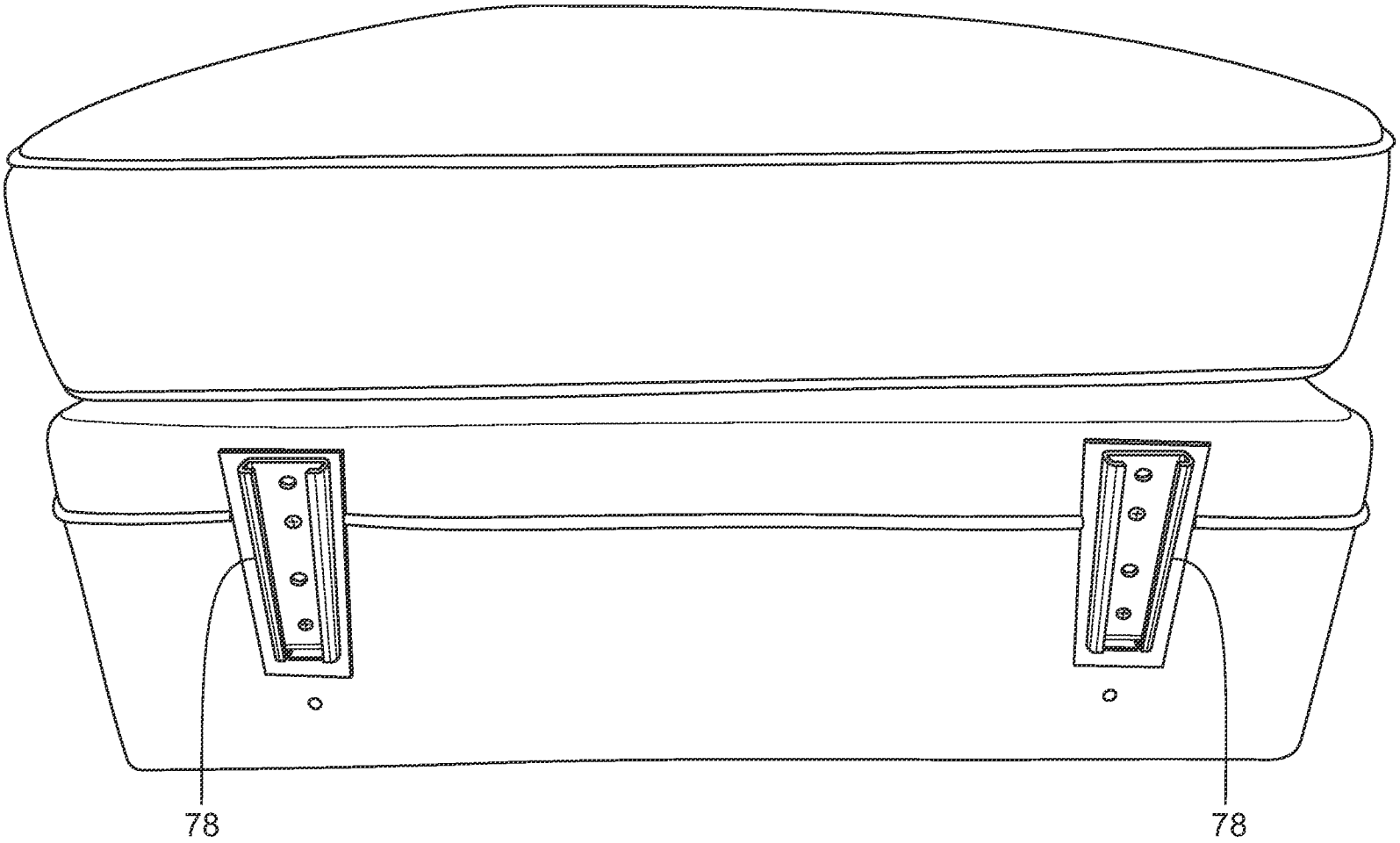

Once two seats 12 are connected, each seat can be provided a cushion 68 which will cover and hide the connection plate 54. A seat 10 with a seat cushion 68 is shown in FIGS. 20A and 20B. FIG. 20B shows the fabric around the seat 12 having cutouts 78. The cutouts 78 facilitate removal of the fabric (e.g., for replacement or cleaning) without requiring first removing the first connector components 22. The back and arm can include similar cutouts.

Figure 21:
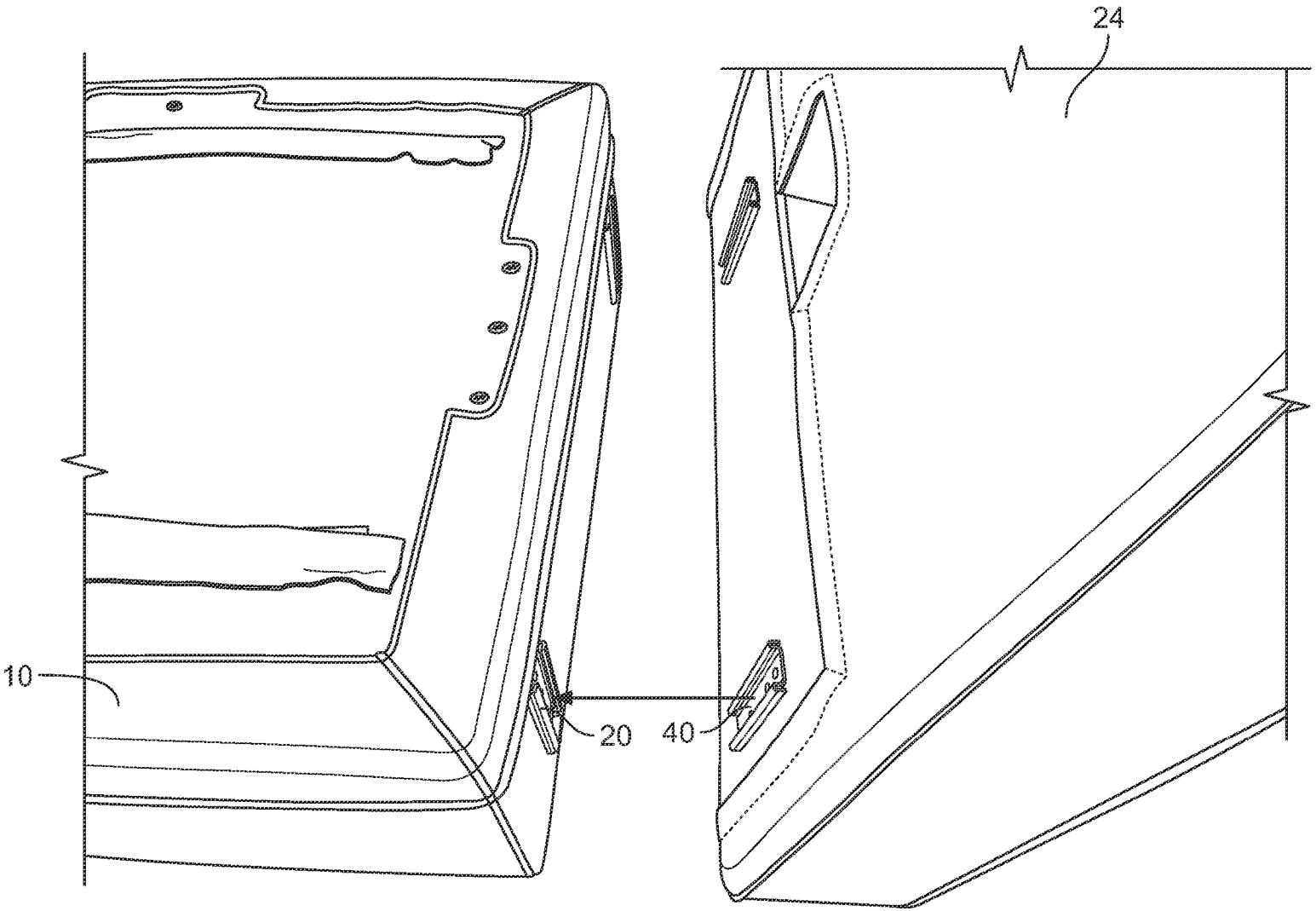
FIG. 21 is a perspective view of a seat unit and a back unit before connection via the first connector components on the seat unit and the second connector components on the back unit.

FIG. 21 shows a back unit 24 and a seat unit 10 slightly separated from the back unit 24. The first connector components 22 on the seat unit 10 are aligned with the second connector units 40 on the back unit 24. Simply lifting the back unit 24 so that the bottom of the second connector components 40 slide over the top of the first connector components 22 secures the back unit 24 to the seat unit 10. A similar procedure is used to secure the arm unit 42 to the seat unit 10.

Figure 22:
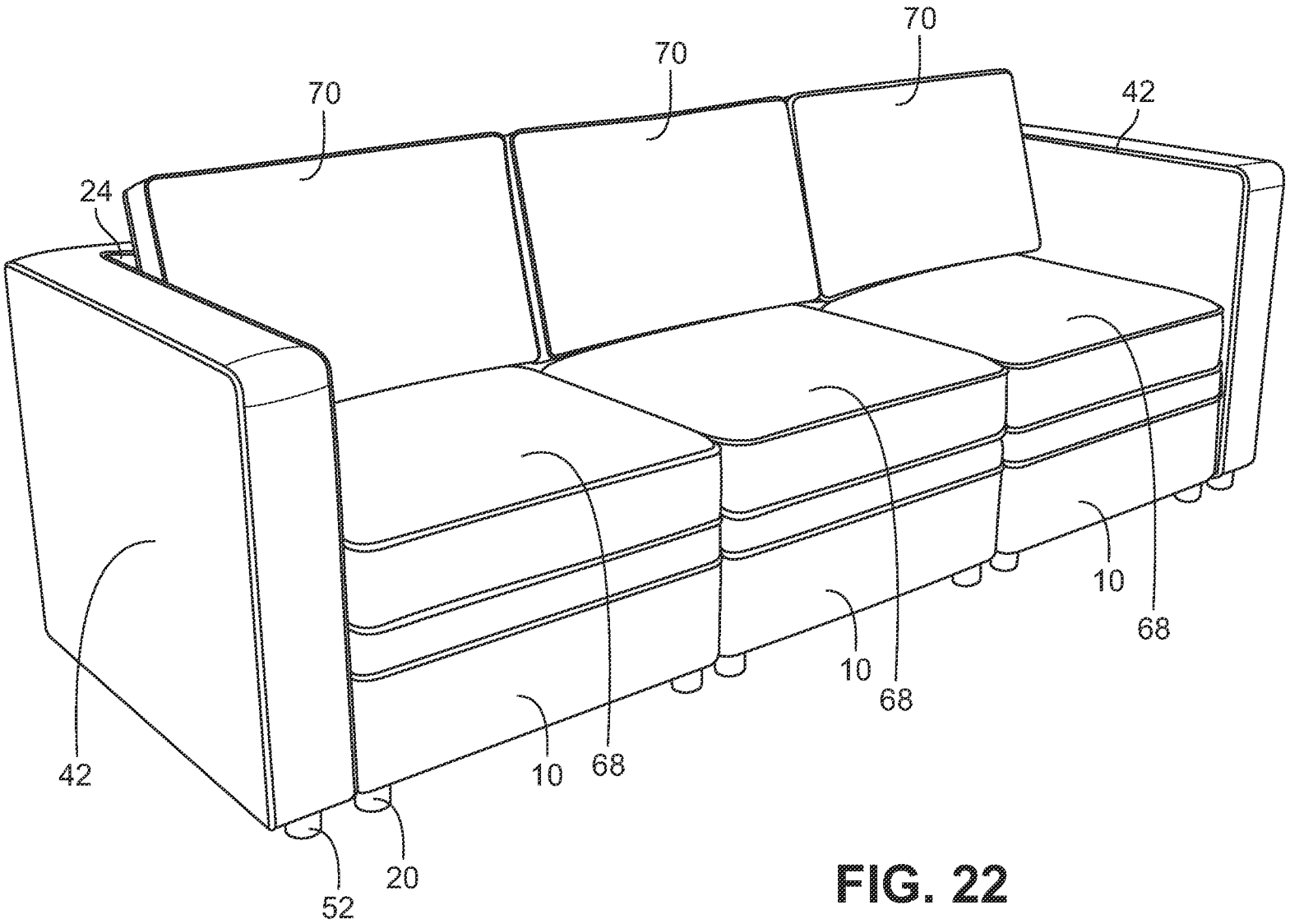
FIG. 22 is a perspective view of a modular seating system in accordance with one aspect of the invention.

FIG. 22 shows one combination of the components of the seating system configured as a couch. In addition, the seat cushion 68, the couch also includes back cushions 70. The cushions can be loose, or alternatively, secured to the seat or back units by hook and loop material, snaps or other similar means.

Figure 23:
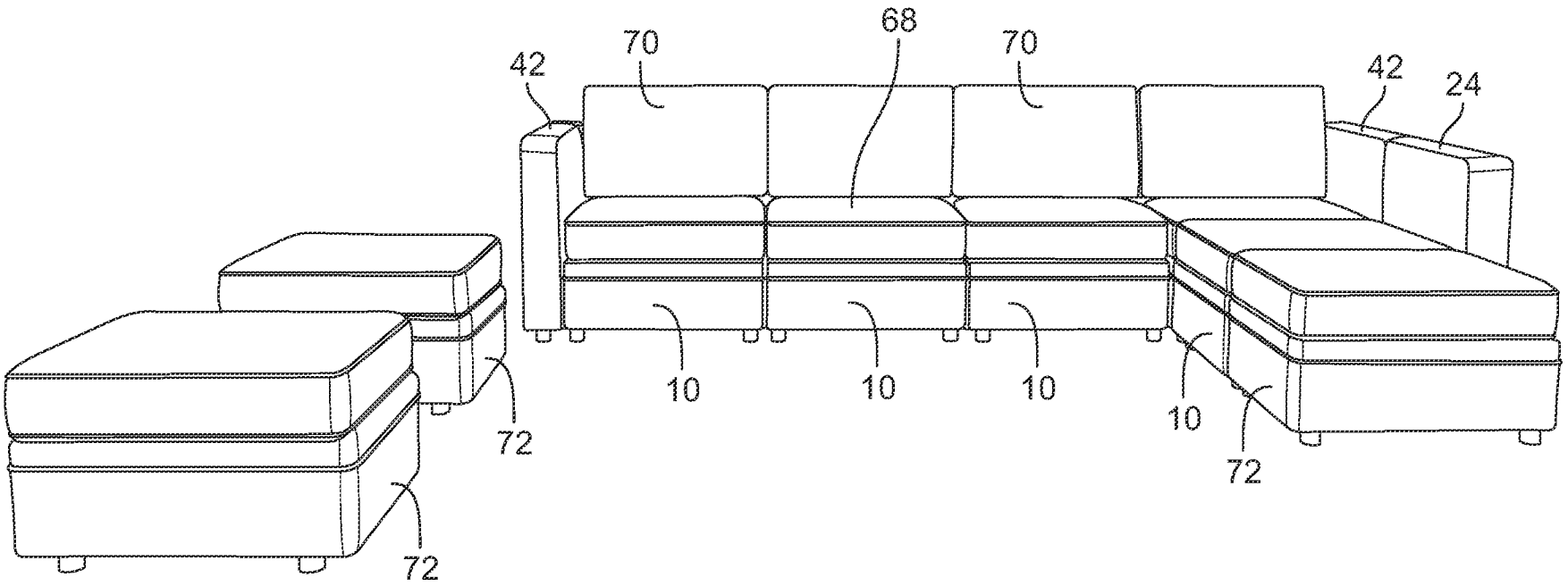
FIG. 23 is a perspective view of a modular seating system in accordance with another aspect of the invention.
Figure 24:
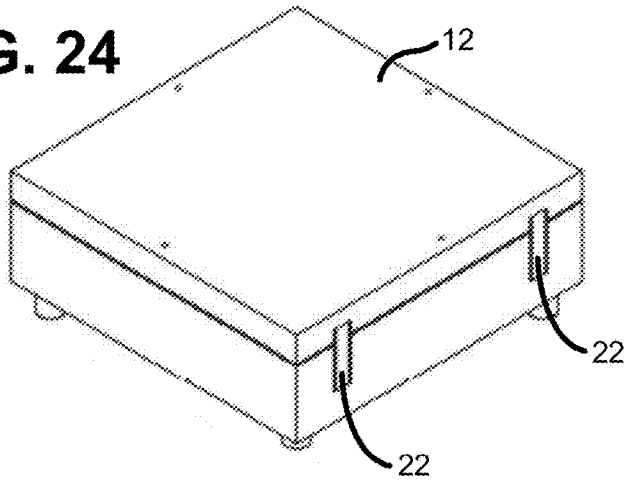
FIG. 24 is a perspective view of another seat for use in the present invention having first connector components on only one side of the seat for connection to a back.
Figure 25B:
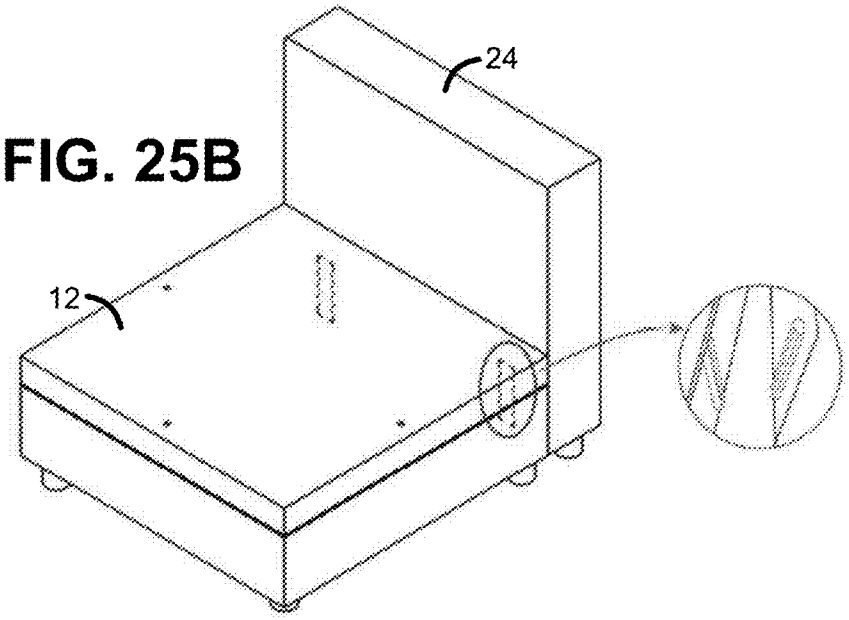
FIGS. 25A-25B show a back being connected to the seat of FIG. 24; and, FIGS. 26A-26C show views of the first connector component and the second connector component without seats, backs or arms.
Figure 25A:
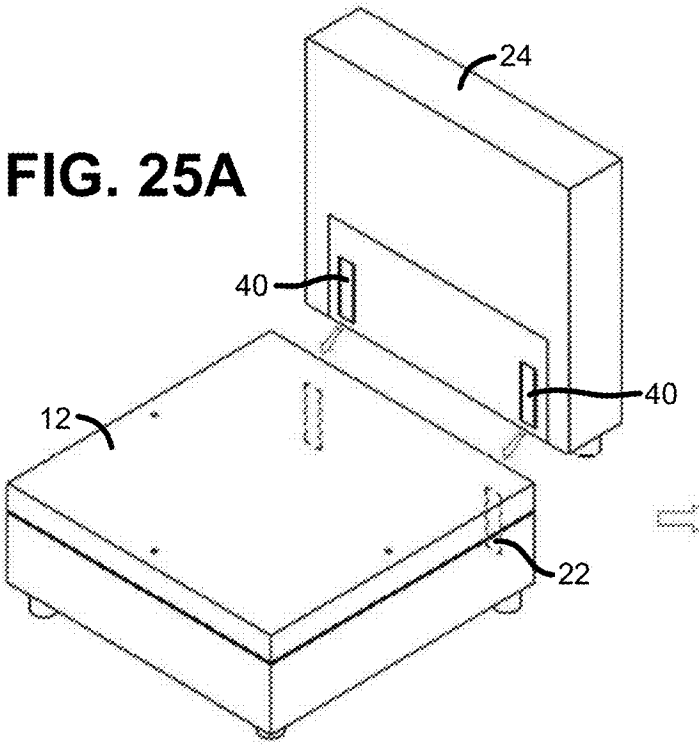

FIG. 23 shows an L-shaped configuration of the seating system. Additionally, seat units 72 without connector components can be utilized in the system. Instead of legs, these units can be provided with rollers to easily move them around.

The seat 10 is preferably 800 mm×800 mm×320 mm, the back 24 is 800 mm×700 mm×160 mm, and the arm 42 is 960 mm×700 mm×160 mm. The legs 52 are 60 mm×60 mm.

Many modifications and variations of the present invention are possible in light of the above teachings. It is, therefore, to be understood within the scope of the appended claims the invention may be protected otherwise than as specifically described.

I claim:

1. A modular seating system comprising:

a first seat having an upper surface, a first side wall extending downward from the upper surface, a second side wall extending down from the upper surface, a front wall extending downward from the upper surface and a back side wall extending downward from the upper surface, the first side wall having a first set of first connector components and the back wall having a first set of first connector components;

a first arm having a first set of second connector components for connecting the first arm to the first side wall of the first seat in a first position to provide a first selectable arm configuration for the system and a second set of second connector components for connecting the first arm to the first side wall of the first seat in a second position different than the first position to provide a second selectable arm configuration for the system different than the first selectable arm configuration; and, a first back having a first set of second connector components, the first back connected to the back wall of the first seat.

2. The modular seating system of claim 1 wherein each of the first connector components is a rail secured to the first seat.

3. The modular seating system of claim 2 wherein each of the second connector components is a slider having a generally squared off C-shaped cross-sectional shape configured to slideably fit over a respective rail.

4. The modular seating system of claim 1 wherein the first seat includes a lower surface and a plurality of legs extending downward from the lower surface of the first seat.

5. The modular seating system of claim 1 further comprising a first set of first connector components on the second side wall of the first seat.

6. The modular seating system of claim 5 further comprising a second arm having a first set of second connector components for connecting the second arm to the seat in a first position and a second set of second connector components for connecting the second arm to the seat in a second position different than the first position.

7. The modular seating system of claim 1 further comprising a second seat having an upper surface, and a first connector plate connecting the upper surface of the first seat to an upper surface of the second seat.

8. The modular seating system of claim 7 wherein the first connector plate includes a first opening and a second opening.

9. The modular seating system of claim 8 further comprising a first screw for securing the first plate to the first seat through the first opening and a second screw for securing the first connector plate to the second seat through the second opening.

10. The modular seating system of claim 7 wherein the second seat includes a first side wall having a first set of first connector components and a back wall having a first set of first connector components.

11. The modular seating system of claim 10 further comprising:

a second arm having a first set of second connector components for connecting the arm to the second seat in a first position and a second set of second connector components for connecting the second arm to the second seat in a second position different than the first position, the second arm connected to the first side wall of the second seat; and, a second back having a first set of second connector components, the second back connected to the back wall of the second seat.

12. The modular seating system of claim 1 wherein the upper surface of the first seat is square and includes a seat cushion.

13. A modular seating system comprising:

a first seat having an upper surface, a first side wall extending downward from the upper surface, a second side wall extending down from the upper surface, a front wall extending downward from the upper surface and a back side wall extending downward from the upper surface, the first side wall having a first set of first connector components to provide for a first selectable arm configuration for the system and a second set of first connector components to provide for a second selectable arm configuration for the system different than the first selectable arm configuration, and the back wall having a first set of first connector components;

a first arm having a first set of second connector components; and, a first back having a first set of second connector components, the first back connected to the back wall of the first seat.

14. The modular seating system of claim 13 wherein each of the first connector components is a rail secured to the first seat.

15. The modular seating system of claim 14 wherein each of the second connector components is a slider having a generally squared off C-shaped cross-sectional shape configured to slideably fit over a respective rail.

16. The modular seating system of claim 13 further comprising a second seat having an upper surface, and a first connector plate connecting the upper surface of the first seat to the upper surface of the second seat.

17. A modular seating system comprising:

a first seat having an upper surface and a lower surface, a first side wall extending downward from the upper surface, a second side wall extending down from the upper surface, a front wall extending downward from the upper surface and a back side wall extending downward from the upper surface, the first side wall having a first set of first connector components and the back wall having a first set of first connector components;

a first arm having a first set of second connector components for connecting the first arm to the first side wall of the first seat in a first position;

a first back having a back outer surface and a front inner surface, a bottom surface and an upper surface, the first back including a first set of second connector components on the front inner surface, the first back connected to the back wall of the first seat;

a second seat having an upper surface and a lower surface; and, a connector plate connecting the upper surface of the first seat to the upper surface of the second seat.

18. The modular seating system of claim 17 wherein the first arm having a second set of second connector components for connecting the first arm to the first side wall of the first seat in a second position different than the first position.

19. The modular seating system of claim 17 wherein each of the first connector components is a rail secured to the first seat and each of the second connector components is a slider having a generally squared off C-shaped cross-sectional shape configured to slideably fit over a respective rail.

20. A modular seating system comprising:

a first seat having an upper surface, a first side wall extending downward from the upper surface, a second side wall extending down from the upper surface, a front wall extending downward from the upper surface and a back side wall extending downward from the upper surface, the first side wall having a first set of first connector components and the back wall having a first set of first connector components;

a first arm having a first set of second connector components for connecting the first arm to the first side wall of the first seat in a first position and a second set of second connector components for connecting the first arm to the first side wall of the first seat in a second position different than the first position; and, a first back having a back outer surface and a front inner surface, a bottom surface and an upper surface, the first back including a first set of second connector components on the front inner surface, the first back connected to the back wall of the first seat.

* * * * *